US007383657B2

(12) United States Patent
Pikielny

(10) Patent No.: US 7,383,657 B2
(45) Date of Patent: Jun. 10, 2008

(54) MAGAZINE LOADER

(76) Inventor: Dov Pikielny, 7 Dov Hoz Street, Herzliya 46581 (IL)

( * ) Notice: Subject to any disclaimer, the term of this patent is extended or adjusted under 35 U.S.C. 154(b) by 465 days.

(21) Appl. No.: 11/182,818

(22) Filed: Jul. 18, 2005

(65) Prior Publication Data

US 2007/0017140 A1 Jan. 25, 2007

(51) Int. Cl.
*F41A 9/61* (2006.01)

(52) U.S. Cl. ..... 42/87; 42/90; 89/33.1

(58) Field of Classification Search ..... 42/87, 42/90, 106; 89/33.1
See application file for complete search history.

(56) References Cited

U.S. PATENT DOCUMENTS 4,719,715 A * 1/1988 Howard ..... 42/87
6,817,134 B2 * 11/2004 Newman ..... 42/87
2006/0064913 A1 * 3/2006 Gablowski et al. ..... 42/72

* cited by examiner

*Primary Examiner*—J. Woodrow Eldred
*Assistant Examiner*—John W Eldred
(74) *Attorney, Agent, or Firm*—Dekel Patent Ltd; David Klein

(57) ABSTRACT

A magazine loader including a body including a front strap, a back strap and side panels extending between the front and back straps, a hollow portion being defined between the front and back straps and side panels for receiving therein a fire-arms magazine, wherein the front and back straps and side panels are configured to substantially match an outer contour of a grip of a given manufacturer's weapon, and a tongue extending from an upper portion of the body with a cartridge contact surface that faces towards the hollow portion, wherein when a magazine is placed in the hollow portion the cartridge contact surface is positioned to push a cartridge into the magazine.

12 Claims, 3 Drawing Sheets

MAGAZINE LOADER

FIELD OF THE INVENTION

The present invention relates generally to cartridge loading in a firearm magazine, and particularly to a simplified device for manually loading cartridges into a firearm magazine.

BACKGROUND OF THE INVENTION

It is common practice to load cartridges into a firearm magazine by progressive compression of the magazine's spring. The cartridges are inserted one at a time against the ever increasing spring resistance as the magazine approaches a fully-loaded condition. If the next cartridge is simply loaded against the previously loaded cartridge, it is recognized that considerable force and manual dexterity are required.

The unaided loading of a firearm magazine is time consuming and difficult, especially when trying to push in the last few cartridges into the magazine. Moreover, loading by pressing down with one's fingers without any manual assistance can lead to misalignment of cartridges within the magazine and possible jamming of the cartridges. In order to overcome such problems, there have been many different types of manual devices that have been developed to aid in magazine loading.

SUMMARY OF THE INVENTION

The present invention seeks to provide a simplified device for manually loading cartridges into a firearm magazine, as is described more in detail hereinbelow.

There is provided in accordance with an embodiment of the present invention a magazine loader including a body including a front strap, a back strap and side panels extending between the front and back straps, a hollow portion being defined between the front and back straps and side panels for receiving therein a firearms magazine, wherein the front and back straps and side panels are configured to substantially match an outer contour of a grip of a given manufacturer's weapon, and a tongue extending from an upper portion of the body with a cartridge contact surface that faces towards the hollow portion, wherein when a magazine is placed in the hollow portion the cartridge contact surface is positioned to push a cartridge into the magazine.

The front and back straps and side panels may be configured to substantially match a texture of the grip of the given manufacturer's weapon. The front strap may be formed with a hole for a magazine catch.

The front and/or back strap may or may not be straight. The texture of the front and/or back straps and/or the side panels may include at least one of grooves, checkering, stippling and conical pyramids.

A thumb rest may protrude from an upper portion of the back strap. At least one of the side panels may have a logo of the given manufacturer's weapon formed thereon.

There is also provided in accordance with an embodiment of the present invention a magazine loader including a body including a front strap, a back strap and side panels extending between the front and back straps, a hollow portion being defined between the front and back straps and side panels for receiving therein a firearms magazine, a magazine catch installed in the body and adapted to resiliently catch on to a firearms magazine received in the hollow portion, and a tongue extending from an upper portion of the body with a cartridge contact surface that faces towards the hollow portion, wherein when a magazine is placed in the hollow portion the cartridge contact surface is positioned to push a cartridge into the magazine. The tongue (or a portion thereof) may slide in a hollow channel formed in the body. A biasing device may be located in the channel that urges and resets the tongue to its original position after pushing a cartridge into the magazine.

There is also provided in accordance with an embodiment of the present invention a magazine loader including a body including a front strap, a back strap and side panels extending between the front and back straps, a hollow portion being defined between the front and back straps and side panels for receiving therein a firearms magazine, a magazine catch installed in the body and adapted to resiliently catch on to a firearms magazine received in the hollow portion, and a trigger-operated mechanism adapted to push a cartridge into a firearms magazine received in the hollow portion.

BRIEF DESCRIPTION OF THE DRAWINGS

The present invention will be understood and appreciated more fully from the following detailed description taken in conjunction with the drawings in which.

DETAILED DESCRIPTION OF EMBODIMENTS

Figure 1:
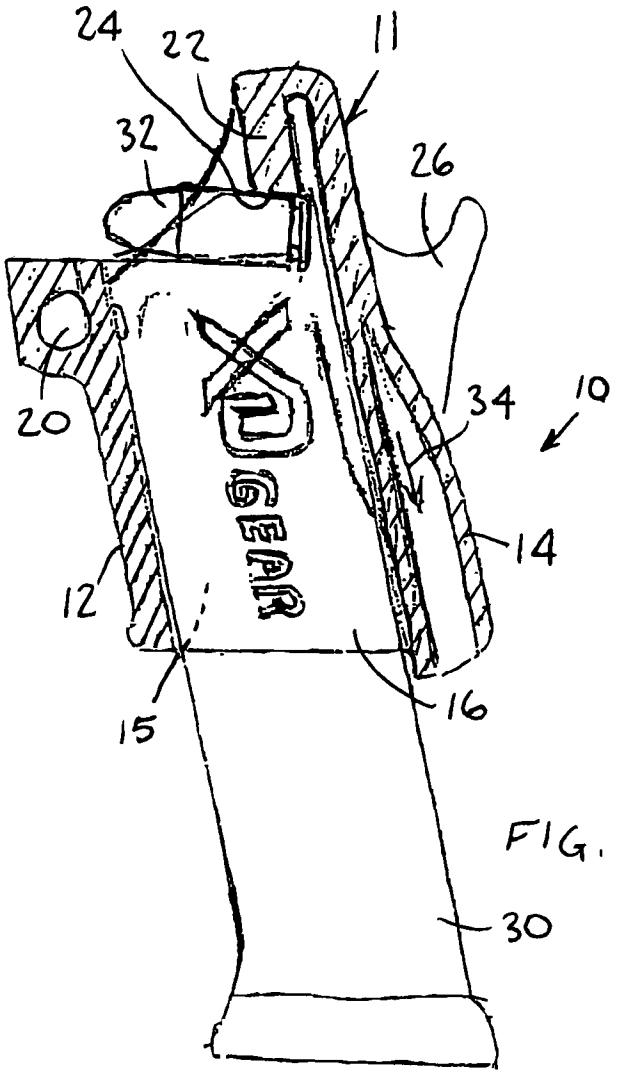
FIGS. 1 and 2 are simplified front and side view illustrations of a magazine loader constructed and operative in accordance with an embodiment of the present invention.
Figure 2:
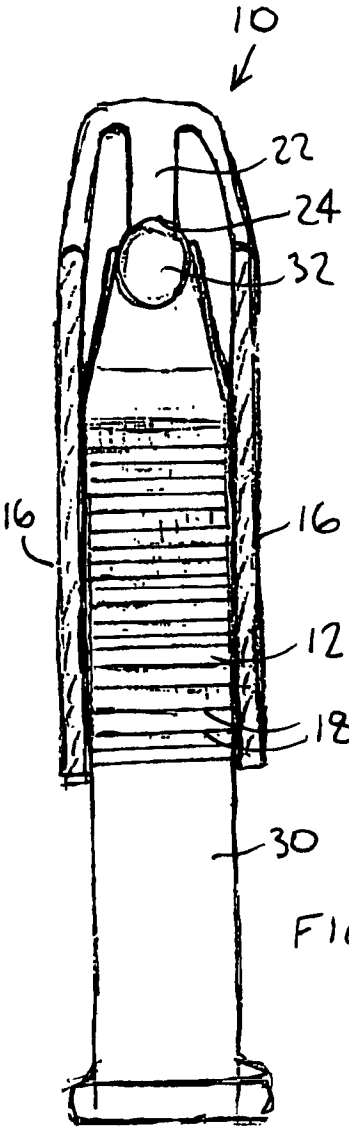

Reference is now made to FIGS. 1 and 2, which illustrate a magazine loader 10, constructed and operative in accordance with an embodiment of the present invention.

The magazine loader 10 may be constructed of any suitable material, such as but not limited to, polymer, composite material, metal, wood, elastomer (e.g., rubber) and others. The magazine loader 10 may include a body 11 that has a front strap 12, a back strap 14 and side panels 16 extending between the front and back straps 12 and 14. A hollow portion 15 is defined between front and back straps 12 and 14 and side panels 16 for receiving therein a firearms magazine 30. The front and back straps 12 and 14 and the side panels 16 may be configured to substantially match an outer contour of a grip of a given manufacturer's weapon (e.g., handgun, pistol, submachine gun, or any kind of firearms that employs magazines).

For example, in the non-limiting illustrated embodiment, the weapon is the XD model handgun, commercially available from Springfield Armory. The XD comes in a model with a full-size grip and another model with a compact grip (shorter in length than the full-size grip) and a sub-compact model. The magazine loader 10 illustrated in FIG. 1 has the exact same contour as the upper portion of the grip of the full-size, compact or sub-compact XD. Accordingly, in the illustrated embodiment, the front strap 12 is generally straight, whereas the back strap 14 is not straight, rather curved to match and continue the curvature of the back strap of the XD.

The front and back straps of the XD's grip have a series of grooves formed therein. As is well known in the art, the grooves provide a certain texture to the grip for enhanced comfort and gripping ability. Accordingly, front and back straps 12 and 14 may have a series of grooves 18 formed therein to match the texture of the XD grip. (Other textures are also known in the art, examples of which are described hereinbelow.) One or both of the side panels 16 of the magazine loader 10 may have the logo "XD" or "XD Gear" molded or otherwise formed therein, to match the design of the XD grip.

The grip of the XD model handguns, like most handguns, has a hole for the pin or other mechanism of the magazine catch. Accordingly, front strap 12 may be formed with a hole 20 that matches the hole for a magazine catch of the weapon (not shown). This hole 20, also referred to as magazine catch hole 20, may be of particular use in the embodiments described with reference to FIGS. 3 and 4 hereinbelow.

The magazine loader 10 may have a tongue 22 that extends from an upper portion of body 11. In the non-limiting illustrated embodiment, tongue 22 extends upwards from back strap 14 and bends downwards with a cartridge contact surface 24 that faces towards the hollow portion 15. When the magazine 30 is placed in hollow portion 15, the cartridge contact surface 24 is positioned to push a cartridge 32 into magazine 30 by pushing magazine loader 10 downwards in the direction of arrow 34. The magazine loader 10 may further include a thumb rest 26 that protrudes from an upper portion of back strap 14, which may provide more convenient pushing power to push the cartridges 32 into the magazine 30.

As mentioned previously, the front and back straps 12 and 14 may have a texture to match the grip of the XD, wherein the front and back straps 12 and 14 have a series of grooves 18 formed therein to match those of the XD's grip. Many other textures are also known in the art, and the present invention also contemplates using any texture or combination of textures. For example, without limitation, the texture may include checkering (e.g., 20-50 lines per inch), stippling, conical pyramids (also known as "Conamyds", created by gunsmith Ned Christiansen of Three Rivers, Mich., which comprise complex intersections and lines milled into the front strap), or snakeskin pattern (made by Ed Brown of Perry, Mo., comprising a complex pattern of machined ridges on the front strap that resemble a snake's scale pattern).

Figure 3:
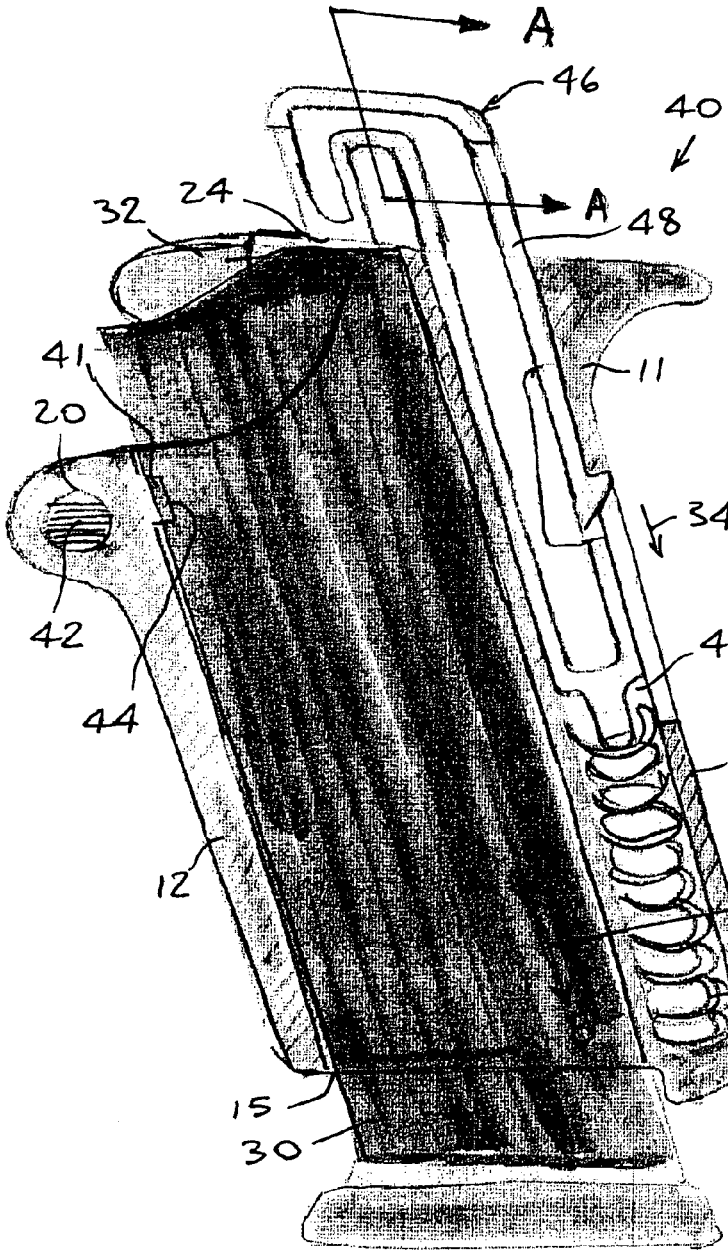
FIGS. 3, 3A and 3B are simplified pictorial and sectional illustrations of a magazine loader constructed and operative in accordance with another embodiment of the present invention, FIGS. 3A and 3B being taken along lines A-A and B-B respectively in FIG. 3.
Figure 3A:
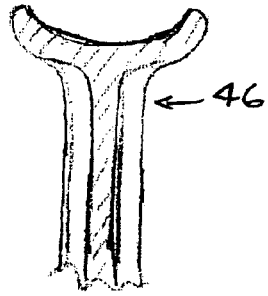
Figure 3B:
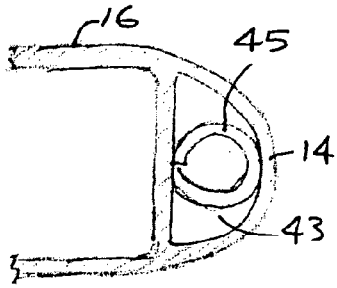

Reference is now made to FIGS. 3, 3A and 3B, which illustrate a magazine loader 40, constructed and operative in accordance with another embodiment of the present invention.

The magazine loader 40 may be constructed similarly to magazine loader 10, with like elements being designated by like numerals. Magazine loader 40 may include a magazine catch 42 installed in magazine catch hole 20. Just as the magazine catch in any weapon with a magazine fixedly holds on to the magazine, as is well known in the art, here too magazine catch 42 resiliently catches on to a recess 44 formed in magazine 30 (e.g., by means of a spring-loaded lug 41).

The magazine loader 40 may have a sliding tongue 46 that extends from an upper portion of body 11. In the non-limiting illustrated embodiment, a rear portion 48 of tongue 46 slides in a hollow channel 43 formed in body 11 inside back strap 14. As with magazine loader 10, tongue 46 may bend downwards with a cartridge contact surface 24 that faces towards the hollow portion 15. When the magazine 30 is placed in hollow portion 15, the magazine 30 is held in place by means of magazine catch 42. Tongue 46 may be pushed downwards in the direction of arrow 34 so that cartridge contact surface 24 pushes cartridge 32 into magazine 30. The rear portion 48 of tongue 46 may be biased by a biasing device (e.g., spring) 45 so that tongue 46 is urged upwards (opposite to arrow 34) and reset to its original position after inserting each cartridge 32 into magazine 30.

The magazine loader 40 thus employs a downwardly-depressed manual mechanism (tongue 46) to push the cartridges into the magazine 30.

Figure 4:
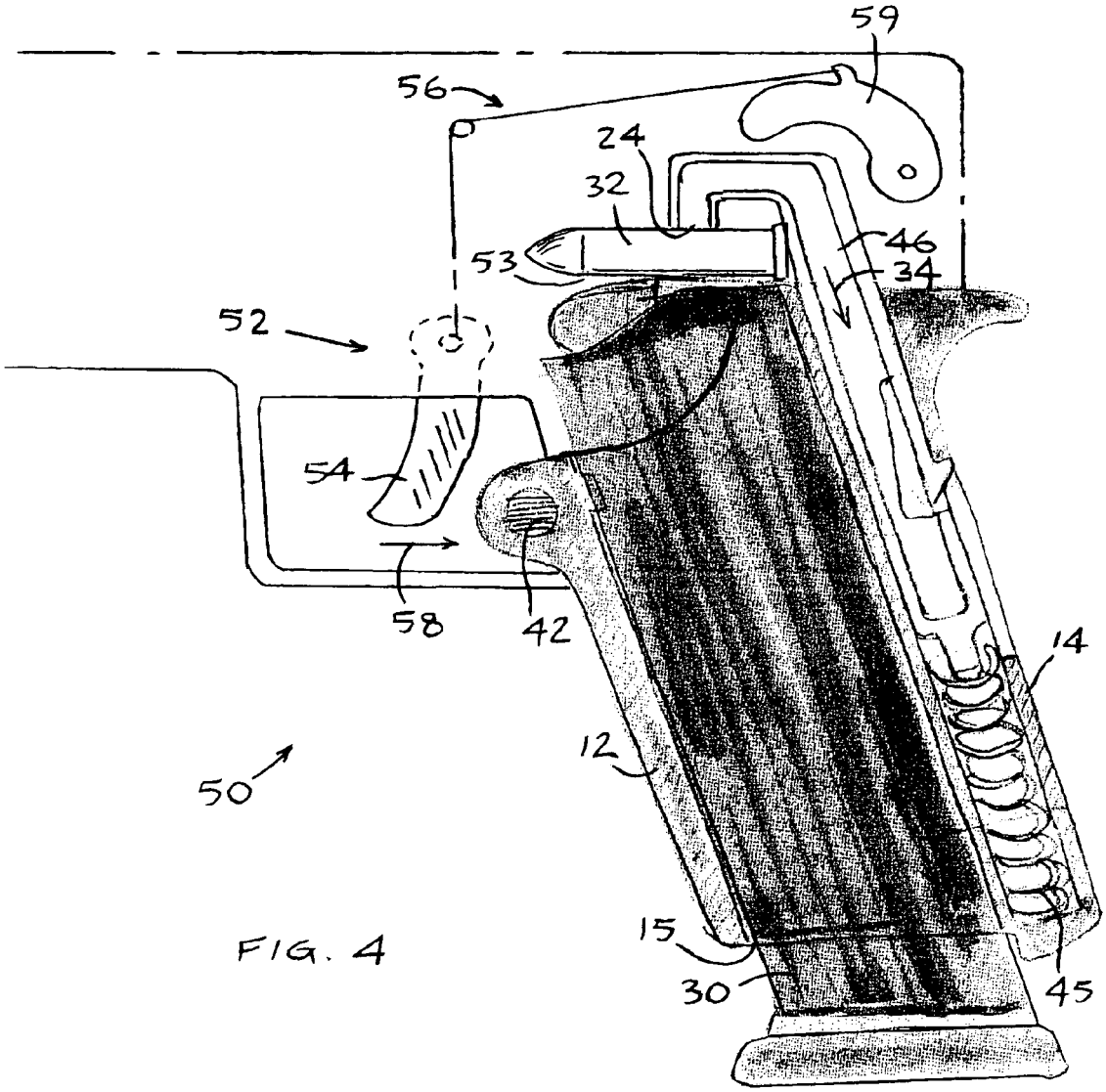
FIG. 4 is a simplified block diagram illustration of a magazine loader constructed and operative in accordance with yet another embodiment of the present invention.

Reference is now made to FIG. 4, which illustrates illustrate a magazine loader 50, constructed and operative in accordance with yet another embodiment of the present invention.

The magazine loader 50 may be constructed similarly to magazine loader 40, with like elements being designated by like numerals. Magazine loader 50 may be considered an extension of magazine loader 40, wherein instead of the downwardly-depressed manual mechanism to push the cartridges into the magazine 30, there is a trigger-operated mechanism 52 to push the cartridges into the magazine 30. In the non-limiting embodiment illustrated in FIG. 4, trigger-operated mechanism 52 includes a trigger 54 connected by a linkage 56 to tongue 46. The cartridges 32 may be placed in a chamber 53, wherein the cartridge is nominally positioned over magazine 30 and below cartridge contact surface 24 of tongue 46. The motion of squeezing trigger 54 in the direction of an arrow 58 is translated by linkage 56 to downward motion of a pivotable cam 59 that depresses tongue 46 in the direction of arrow 34 to push the cartridges into the magazine 30. As described before, spring 45 resets tongue 46 to its original position after inserting each cartridge 32 into magazine 30. The magazine loader 50 is thus a "reverse" weapon—squeezing the trigger pushes the cartridge 32 from the chamber 53 into the magazine 30.

It will be appreciated by persons skilled in the art that the present invention is not limited by what has been particularly shown and described hereinabove. Rather the scope of the present invention includes both combinations and subcombinations of the features described hereinabove as well as modifications and variations thereof which would occur to a person of skill in the art upon reading the foregoing description and which are not in the prior art.

What is claimed is:

1. A magazine loader comprising:

a body comprising a front strap, a back strap and side panels extending between said front and back straps, a hollow portion being defined between said front and back straps and side panels for receiving therein a firearms magazine, said magazine being designed for insertion into a grip of a given manufacturer's weapon; and a tongue extending from an upper portion of said body with a cartridge contact surface that faces towards said hollow portion, wherein when a magazine is placed in said hollow portion said cartridge contact surface is positioned to push a cartridge into said magazine, and wherein said front strap is formed with a hole for installing therein a magazine catch, said hole being positioned on said front strap corresponding in position to a magazine catch hole of the grip of the given manufacturer's weapon into which the magazine is insertable.

2. The magazine loader according to claim 1, wherein said front and back straps and side panels are configured to substantially match a texture of the grip of the given manufacturer's weapon.

3. The magazine loader according to claim 1, wherein said front and back straps and side panels are configured to substantially match an outer contour of a grip of a given manufacturer's weapon.

4. The magazine loader according to claim 1, wherein at least one of said front and back straps is not straight.

5. The magazine loader according to claim 1, wherein the texture of at least one of said front and back straps and said side panels comprises at least one of grooves, checkering, stippling and conical pyramids.

6. The magazine loader according to claim 1, further comprising a thumb rest protruding from an upper portion of said back strap.

7. The magazine loader according to claim 1, wherein at least one of said side panels has a logo of the given manufacturer's weapon formed thereon.

8. A magazine loader comprising:

a body comprising a front strap, a back strap and side panels extending between said front and back straps, a hollow portion being defined between said front and back straps and side panels for receiving therein a firearms magazine;

a magazine catch installed in said body which comprises a spring-loaded lug adapted to resiliently catch on to a recess formed in a firearms magazine received in said hollow portion; and a tongue extending from an upper portion of said body with a cartridge contact surface that faces towards said hollow portion, wherein when a magazine is placed in said hollow portion said cartridge contact surface is positioned to push a cartridge into said magazine.

9. The magazine loader according to claim 8, wherein a portion of said tongue slides in a hollow channel formed in said body.

10. The magazine loader according to claim 9, further comprising a biasing device located in said channel adapted to urge and reset said tongue to its original position after pushing a cartridge into said magazine.

11. A magazine loader comprising:

a body comprising a front strap, a back strap and side panels extending between said front and back straps, a hollow portion being defined between said front and back straps and side panels for receiving therein a firearms magazine;

a magazine catch installed in said body which comprises a spring-loaded lug adapted to resiliently catch on to a recess formed in a firearms magazine received in said hollow portion; and a trigger-operated mechanism adapted to push a cartridge into a firearms magazine received in said hollow portion.

12. The magazine loader according to claim 11, wherein said trigger-operated mechanism comprises a trigger connected by a linkage to a tongue extending from an upper portion of said body with a cartridge contact surface that faces towards said hollow portion, wherein when a magazine is placed in said hollow portion and a cartridge is placed in a chamber above the magazine, squeezing said trigger causes said linkage to move said cartridge contact surface against the cartridge and push the cartridge into said magazine.

* * * * *